United States Patent [19]

Hayashi

[11] Patent Number: 4,467,755

[45] Date of Patent: Aug. 28, 1984

[54] INTERNAL COMBUSTION ENGINE WITH BEARING BEAM STRUCTURE

[75] Inventor: Yoshimasa Hayashi, Yokosuka, Japan

[73] Assignee: Nissan Motor Company, Limited, Yokohama, Japan

[21] Appl. No.: 375,009

[22] Filed: May 5, 1982

[30] Foreign Application Priority Data

May 6, 1981 [JP] Japan ..... 56-65506[U]

[51] Int. Cl.[3] ..... F02F 7/00

[52] U.S. Cl. ..... 123/195 H; 123/195 R; 123/195 C; 384/429; 384/432

[58] Field of Search ..... 123/195 R, 195 C, 195 H; 384/429, 432, 433, 434

[56] References Cited

U.S. PATENT DOCUMENTS

| | | | |
|---|---|---|---|
| 2,997,347 | 8/1961 | Bauer | 384/432 |
| 3,304,134 | 2/1967 | Allen | 123/195 R |
| 4,245,595 | 1/1981 | Abe et al. | 123/195 C |
| 4,327,679 | 5/1982 | Crouch et al. | 123/195 C |

FOREIGN PATENT DOCUMENTS

| | | |
|---|---|---|
| 38560 | 10/1981 | European Pat. Off. . |
| 1328196 | 8/1973 | United Kingdom . |

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

An internal combustion engine comprises a cylinder block including cylinder barrels, and main bearing bulkheads each having a bearing section; main bearing cap sections respectively secured to the bearing bulkheads so that each main bearing cap section and the corresponding cylinder block bearing section associate to constitute a main bearing for rotatably supporting a crankshaft; and a bearing beam structure detachably secured to the main bearing cap sections to connect the main bearing cap sections with each other as a single unit, the bearing beam structure including a plurality of beam sections which are disposed parallel with each other and extend along the row of the main bearing cap sections, the beam sections being connected with each other, thereby effectively decreasing engine noise while facilitating the handling of the engine parts before assembly.

8 Claims, 6 Drawing Figures

INTERNAL COMBUSTION ENGINE WITH BEARING BEAM STRUCTURE

BACKGROUND OF THE INVENTION

1. Field of the Invention

This invention relates to an improvement in an internal combustion engine in order to decrease engine noise, and more particularly to a bearing beam structure, used in the engine, for rigidly connecting a plurality of main bearing cap sections for rotatably supporting a crankshaft, in association with cylinder block bearing bulkheads.

2. Description of the Prior Art

In connection with engine noise, noise emitted from a cylinder block skirt section and an oil pan is mainly caused by the vibration of the cylinder block itself. In order to reduce such vibration noise, it seems enough to suppress the vibration due to explosion torque applied to a crankshaft by increasing the rigidity of the cylinder block. However, this unavoidably leads to an increase in cylinder block wall thickness and accordingly to a great increase in engine weight, thereby giving rise to new problems such as reduced fuel economy. In view of this, a variety of propositions have been made to improve the rigidity of the cylinder block while suppressing an increase in cylinder block weight. Of these propositions, particular attention has been paid to the employment of a bearing beam structure which rigidly connects a plurality of main bearing cap sections for rotatably supporting the crankshaft, in order to improve the mechanical strength of bearing cap sections and engine parts associated therewith.

BRIEF SUMMARY OF THE INVENTION

In accordance with the present invention, an internal combustion engine is composed of a cylinder block including cylinder barrels, and main bearing bulkheads each having a bearing section for a crankshaft. A plurality of main bearing cap sections are respectively secured to the cylinder block main bearing bulkheads so that each main bearing cap section and the corresponding bearing bulkhead bearing section associate with each other to constitute a main bearing for rotatably supporting the crankshaft. Additionally, a bearing beam structure is detachably secured to the main bearing cap sections so as to connect the respective bearing cap sections as a single unit. The bearing beam structure includes a plurality of beam sections which are disposed parallel with each other and extend along the row of the main bearing cap sections, the beam sections being connected with each other. With this arrangement, the rigidity of the cylinder block is effectively improved by virtue of the bearing beam structure. Besides, since the bearing beam structure is detachable relative to the bearing cap sections, the rate of rejects of the product is reduced while facilitating the handling of the parts constituting the engine.

BRIEF DESCRIPTION OF THE DRAWINGS

The features and advantages of the internal combustion engine according to the present invention will be more clearly appreciated from the following description taken in conjunction with the accompanying drawings in which like reference numerals designate like parts and elements, in which.

DETAILED DESCRIPTION OF THE INVENTION

Figure 1:
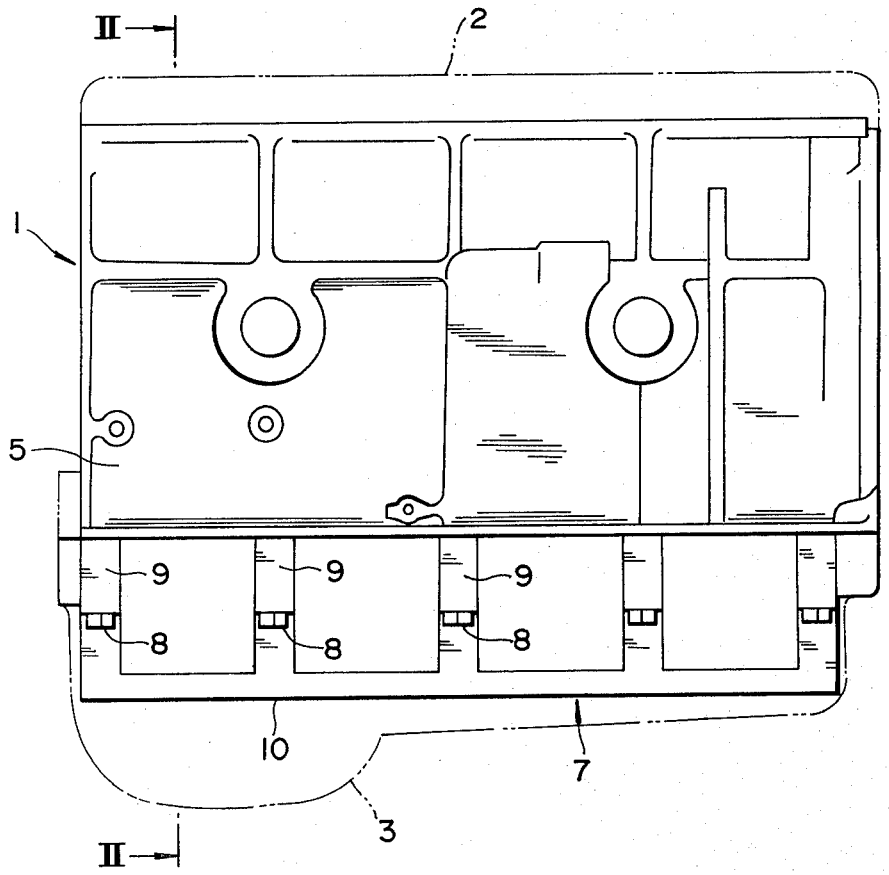
FIG.1 PRIOR ART
FIG. 1 is a side elevation of a conventional internal combustion engine.
Figure 2:
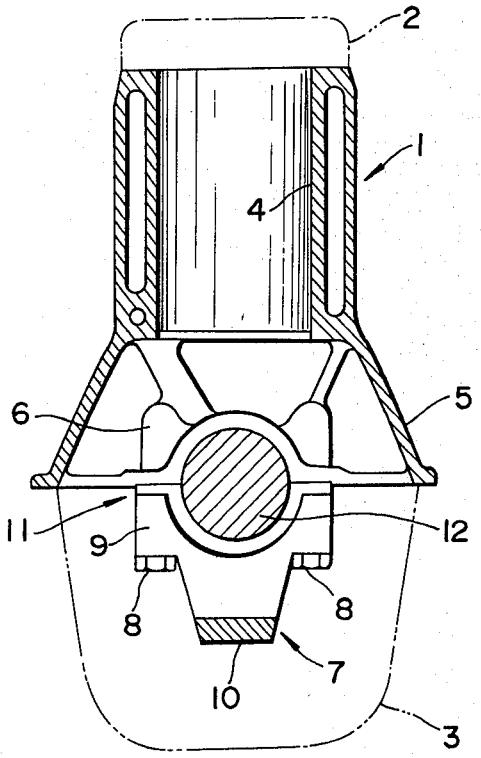
FIG.2 PRIOR ART
FIG. 2 is a vertical sectional view taken in the direction of arrows substantially along the line II—II of FIG. 1.
Figure 3:
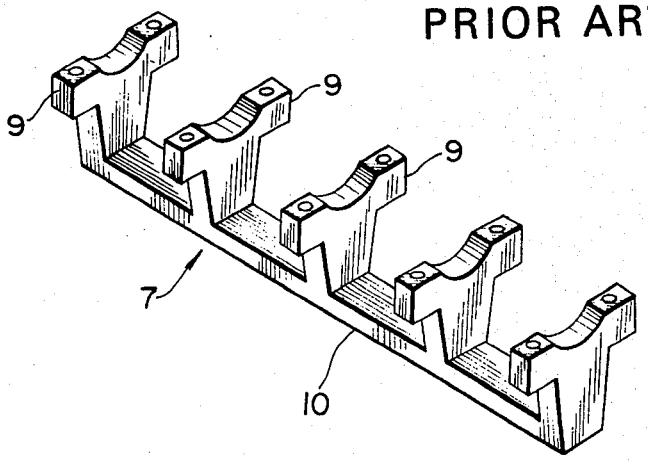
FIG.3 PRIOR ART
FIG. 3 is a perspective view of a bearing beam structure used in the engine of FIG. 1.

To facilitate understanding the invention, brief reference will be made to a conventinal automotive internal combustion engine, depicted in FIGS. 1 to 3. Referring to FIGS. 1 and 2, the engine includes a cylinder block 1 whose top and bottom are provided respectively with a cylinder head 2 and an oil pan 3. The cylinder block 1 is formed at its upper part with a plurality of cylinder barrels 4 and at its lower part with a so-called skirt section 5 which defines thereinside an upper part of a crankcase inner chamber (no numeral). A plurality of main bearing bulkheads 6 are disposed inside of the skirt section 5 and are located at certain intervals so as to divide the crankcase inner chamber upper part into a plurality of sections. The bearing bulkheads 6 are integral with the wall of the skirt section 5. A bearing beam structure 7 is secured to the bottom section of the cylinder block 1 and includes a plurality of main bearing cap sections 9 which are located at certain intervals, and a straight elongated beam section 10 which connects the main bearing cap sections 9 with each other, as best shown in FIG. 3. Each main bearing cap section 9 is secured to each bearing bulkhead 6, respectively, so as to constitute a main bearing 11 by which a crankshaft 12 is rotatably supported. Pistons (not shown), slidably disposed within respective cylinder barrels 4, are connected to this crankshaft 12, so that when each piston makes its reciprocal movement within the cylinder barrel 4 upon receiving a combustion impact load, the crankshaft 12 converts the piston reciprocal movement into the rotational movement thereof.

However, with the thus arranged conventional engine, the bearing beam structure 7 is constituted by the of main bearing cap sections 9 and an elongated beam section 10, and therefore the main bearing cap sections 9 cause their torsional vibration upon transmission of the combustion impact load to the main bearings 11, thus increasing noise from the cylinder block 1 during operation of the engine. Also, since the shape of the bearing beam structure 7 is considerably complicated, the percentage of defective products resulting during production is higher. Futhermore, if the bearing beam structure 7 is stored together with other parts within the same container for the purpose of assemblying an engine, it gets entangled with the other parts. And the bearing beam structure may deform, particularly bend, when carelessly treated.

Figure 4:
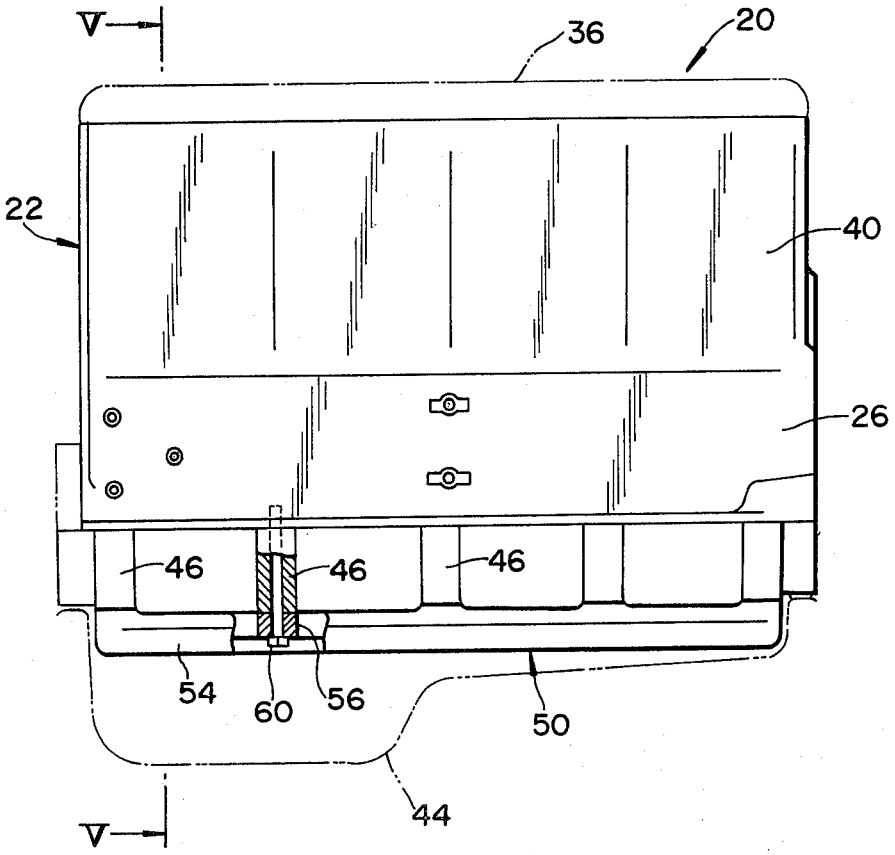
FIG. 4 is a side elevation of a preferred embodiment of an internal combustion engine in accordance with the present invention.
Figure 5:
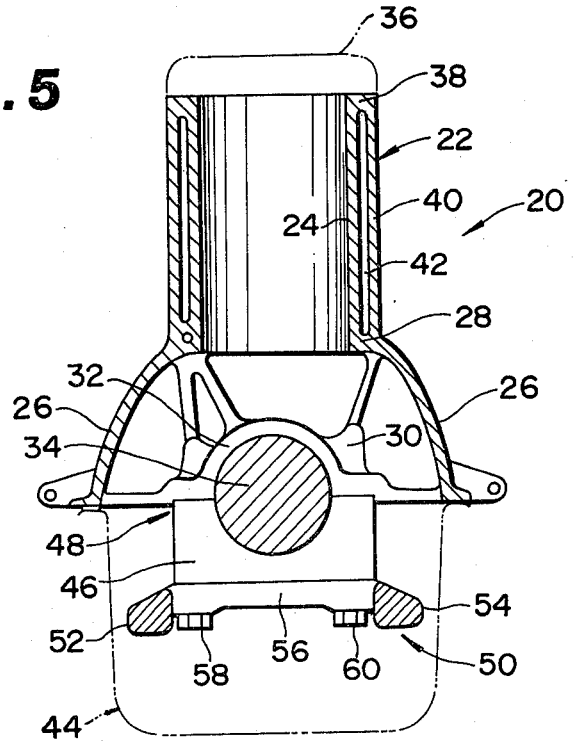
FIG. 5 is a vertical section view taken in the direction of arrows substantially along the line V—V of FIG. 4.
Figure 6:
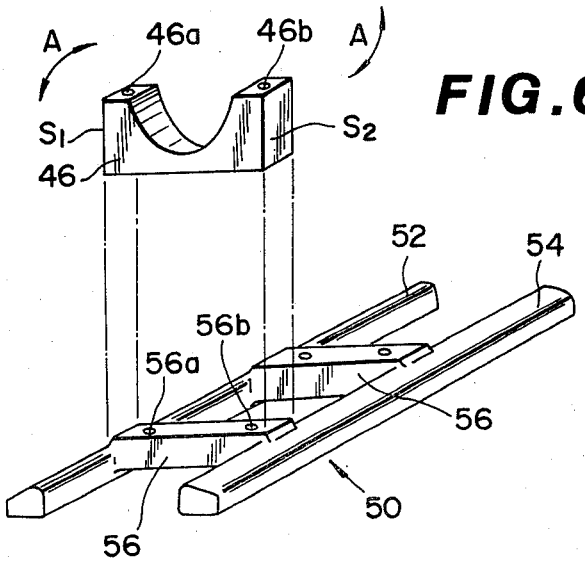
FIG. 6 is an exploded perspective view of the essential part of the engine of FIG. 4.

In view of the above description of the structure of the conventional automotive internal combustion engine, reference is now made to FIGS. 4, 5 and 6, wherein a preferred embodiment of an internal combustion engine according to the present invention is illustrated by the reference numeral 20. The engine 20 in this instance is for an automotive vehicle and comprises a cylinder block 22 which is formed with a plurality of cylinder barrels 24, each of which defines therein a cylinder bore (no numeral). The cylinder block 22 includes a so-called skirt section 26 which is bulged outwardly and extends downwardly to define thereinside the upper part of a crankcase inner chamber (no numeral). The skirt section 26 is integrally connected through a lower block deck 28 with the cylinder barrels 24. A plurality of main bearing bulkheads 30 are disposed parallel to each other inside of the skirt section 26. Each bearing bulkhead 30 is located below and connected to a portion between two neighbouring cylinder barrels 24. The bearing bulkhead 30 is integrally connected at its top part with the lower block deck 28 and at its side parts with the inner wall of the skirt section 26. Each bearing bulkhead 30 is provided at its bottom central portion with a bearing section 32 for receiving the journal of a crankshaft 34.

The reference numeral 36 designates a cylinder head which is secured onto an upper block deck 38 of the cylinder block 22. In this connection, the cylinder barrels 24 are integrally connected through the upper and lower block decks 38, 28 with a cylinder block outer wall 40, thereby defining therebetween a water jacket 42 through which engine coolant circulates. The reference numeral 44 designates an oil pan securely connected to the bottom flange section (no numeral) of the skirt section 26.

A plurality of main bearing cap sections 46 are disposed so as to be secured respectively to the bearing bulkhead 30. Each bearing cap section 46 associates with the bearing section 32 of the bearing bulkhead 30, thereby forming a main bearing 48 by which the journal of the crankshaft 34 is rotatably supported.

A bearing beam structure 50 is secured to the main bearing cap sections 46, but detachable relative to the main bearings 46 and the cylinder block 22. As best shown in FIG. 6, the bearing beam structure 50 includes two spaced and parallel beam sections 52, 54 which extend parallel with the axis of the crankshaft 34 or the axis of the cylinder block 22. The two beam sections 52, 54 are connected with each other by a plurality of connecting sections 56. In this instance, the connecting sections 56 are integral with the beam sections 52, 54 and so located as to be perpendicular to the beam sections 52, 54. The connecting sections 56 are located in the positions corresponding to the bearing cap sections 46 (or bearing bulkheads 30), respectively. Each connecting section 56 is formed with two bolt holes **56*a*, 56*b* whose locations correspond respectively to those of the bolt holes 46*a*, 46*b*, of the bearing cap section 46. Accordingly, a bolt 58 is disposed to pass through the bolt holes 56*a*, 46*a* of the connecting section 56 and the bearing cap section 46, and another bolt 60 is disposed to pass through the bolt holes 56*b*, 46*b* of the connecting section 56 and the bearing cap section 46, so that the bearing beam structure 50 is secured to the cylinder block 22 together with the bearing cap sections 46. In this instance, the length of each connecting section 56 and the distance between the two beam sections 52, 54 are so selected that the extensions of the opposite side surfaces $S_1$, $S_2$ of the bearing cap section 46 lie between the two beam sections 52, 54. The bearing beam structure 50 is formed, for example, of casting of aluminum or aluminum alloy, or iron. In the thus arranged engine, since the bearing beam structure 50 is independent and detachable from the bearing cap sections 46, both the bearing beam structure 50 and the bearing cap sections 46 are simple in shape, thereby noticeably reducing the defect percentage or the rate of rejects during production. Also, even if the bearing beam structure 50 and the bearing cap sections 46** are stored together with other parts in the same container, there is no fear that they get entangled with the other parts.

The manner of operation of the thus arranged engine will be discussed hereinafter. During the operation of the engine, combustion impact load generated within the cylinder barrels 24 is transmitted through the piston and the crankshaft 34 to the main bearing cap section 46. As a result, the bearing cap section 46 seems to be twisted in the direction of arrows A shown in FIG. 6; however, such twisting of the bearing beam section 46 is, in fact, effectively prevented because each bearing cap section 46 is fixed at its opposite side portions onto the connecting section 56, and additionally the connecting section 56 is further fixed at its opposite end portions to the beam sections 52, 54. Furthermore, the height of the bearing cap section 46, in fact, increases by the amount corresponding to the height of the connecting section 56, and accordingly the bearing cap section 46 is prevented from readily bending in the downward direction. Moreover, since a plurality of bearing cap sections 46 are securely connected with each other by the bearing beam structure 50, each bearing cap section 46 is greatly restricted in the vibration in the fore-and-aft direction of the cylinder block, which vibration so acts on the each bearing cap section in the direction to cause it to come down. Additionally, since the bearing beam structure beam sections 52, 54 are located outside of the bearing cap sections 46, the cylinder block 22 is improved in its torsional rigidity. This effectively suppresses vibration of the cylinder block 22, thereby decreasing noise due to such vibration.

It is preferable that the cylinder block 22 and the main bearing cap sections 46 are made of the same material, for example, cast iron or aluminum-light alloy in order to facilitate the simultaneous machining of the bolt holes of the bearing cap sections 46 and the bearing bulkheads 30. It is more preferable that the cylinder block 22 and the bearing cap sections 46 are made of aluminum-light alloy, because aluminum-light alloy is higher in the value of Young's modulus/density than cast iron, thereby greatly contributing to noise suppression.

As appreciated from the above, according to the present invention, the main bearing cap sections are rigidly connected with each other by means of the bearing beam structure which is constituted by a plurality of beam sections and the connecting sections, thereby decreasing engine noise emission. Besides, since the bearing beam structure is detachable relative to the bearing cap sections, the percentage of defective products is decreased while providing an advantage in that the bearing beam structure does not get entangled even if it is stored together with other parts in the same container.

What is claimed is:

1. An internal combustion engine comprising:

a cylinder block including cylinder barrels, and main bearing bulkheads each having a bearing section for a crankshaft;

main bearing cap sections respectively secured to said bearing bulkheads so that each main bearing cap section and the corresponding cylinder block bearing section associate to constitute a main bearing for rotatably supporting said crankshaft; and a bearing beam structure detachably secured to said main bearing cap sections to connect said main bearing cap sections with each other as a single unit, said bearing beam structure including a plurality of beam sections which are disposed parallel to each other and extend along a row of said main bearing cap sections, said beam sections being connected with each other, said plurality of beam sections including two beam sections which are located on opposite sides of and spaced from a vertical plane containing an axis of said crankshaft.

2. An internal combustion engine as claimed in claim 1, wherein said cylinder block and said bearing cap sections are made of the same material.

3. An internal combustion engine as claimed in claim 2, wherein said cylinder block and said bearing cap sections are made of light alloy containing aluminum.

4. An internal combustion engine as claimed in claim 1, wherein said bearing beam structure includes a plurality of connecting sections which are disposed parallel to each other to connect said beam sections with each other, each connecting section being connected at opposite end portions with said beam sections, and disposed perpendicularly to said beam sections.

5. An internal combustion engine as claimed in claim 4, wherein said bearing beam structure beam sections are located outside relative to opposite side ends of each bearing cap section.

6. An internal combustion engine as claimed in claim 5, wherein the opposite side ends of each bearing cap section are formed, respectively, within vertical planes which are parallel with each other, said vertical planes being between said bearing beam structure two beam sections.

7. An internal combustion engine as claimed in claim 4, said bearing beam structure connecting sections are located respectively at positions corresponding to said main bearing cap sections, and are detachably secured respectively, to said main bearing cap sections.

8. An internal combustion engine as claimed in claim 7, wherein each bearing beam structure connecting section is formed with bolt holes which are respectively located at positions corresponding to bolt holes of each bearing cap section, through which corresponding holes a bolt passes through to be screwed into said cylinder block.

* * * * *